US005285617A

United States Patent [19]

Romig et al.

[11] Patent Number: 5,285,617

[45] Date of Patent: Feb. 15, 1994

[54] METHOD OF ASSEMBLING A HAZARDOUS MATERIAL CONTAINER STORAGE BUILDING

[75] Inventors: Frederick W. Romig, Wexford; Charles D. Ledford, New Alexandria, both of Pa.

[73] Assignee: CID Associates, Inc., Leechburg, Pa.

[21] Appl. No.: 997,050

[22] Filed: Dec. 28, 1992

Related U.S. Application Data

[62] Division of Ser. No. 678,830, Apr. 2, 1991, Pat. No. 5,191,742.

[51] Int. Cl.[5] ..... E04G 21/00

[52] U.S. Cl. ..... 52/745.01; 52/79.1; 52/79.9; 52/127.12; 588/249

[58] Field of Search ..... 52/79.1, 79.9, 127.12, 52/745.01, 745.02, 223.7, 220.8, 220.5; 588/249

[56] References Cited

U.S. PATENT DOCUMENTS

| | | | |
|---|---|---|---|
| 2,971,295 | 2/1961 | Reynolds | 52/223.7 |
| 4,605,257 | 8/1986 | Lang et al. | 52/79.7 |
| 4,655,012 | 4/1987 | Downey et al. | 52/79.8 |
| 4,786,201 | 11/1988 | Huetler et al. | 52/127.12 |

*Primary Examiner*—Carl D. Friedman
*Assistant Examiner*—Christopher Todd Kent
*Attorney, Agent, or Firm*—Arnold B. Silverman; David V. Radack

[57] ABSTRACT

A hazardous waste material container storage building comprising a plurality of modules, each module having a floor for supporting containers of hazardous waste materials and tubes underlying the floor. In one embodiment, a first and second module are provided. The invention further comprises a mechanical joining mechanism extending through the first module tube and the second module tube for securing the first module to the second module. The first and second modules are joined to create a single, unitary hazardous waste material storage building. A related method is also disclosed. Another embodiment of a hazardous waste material container storage building comprises providing a plurality of modules, each having a securing member disposed on the roof of each module. Two modules are joined by connecting a fastener to the securing members of each respective module. A related method is also disclosed. The first and second embodiment may be used in the same installation. A grid system design for hazardous waste material container storage is also disclosed.

5 Claims, 6 Drawing Sheets

METHOD OF ASSEMBLING A HAZARDOUS MATERIAL CONTAINER STORAGE BUILDING

This is a division of application Ser. No. 07/678,830, filed Apr. 2, 1991, now U.S. Pat. No. 5,191,742.

BACKGROUND OF THE INVENTION

1. Field Of The Invention

This invention relates to a hazardous waste material container storage building and a related method, and in particular to a modular and portable system which can store hazardous waste material containers efficiently and safely.

2. Background Discussion

Hazardous waste is frequently placed in 55-gallon cylindrical barrels typically measuring about 22 to 23½ inches in diameter. The hazardous waste can be stored in a liquid or solid form. These barrels must be kept in a building that has suitable safety features such as proper venting, fire and explosion protection and leakage protection.

A problem has arisen in providing storage for hazardous waste material storage containers. Buildings must be constructed to store the hazardous waste material. These buildings have to comply with safety standards mandated by Federal, state and local law in addition to meeting industry trade standards. However, these buildings need to be constructed quickly and with an eye towards future expansion of the floor space that is required to store hazardous waste material containers. In addition, available space for the containers must be used efficiently in order to minimize storage costs.

Thus, there remains a need for a hazardous waste material container storage system that is designed to accommodate any number of containers of hazardous waste while employing valuable storage space efficiently. There also remains a need for a modular system which allows for flexibility in the size of the building needed to store the hazardous waste.

SUMMARY OF THE INVENTION

The hazardous waste material container storage building and related method of the present invention has met the above needs. The building comprises a plurality of modules, each module having a floor for supporting containers of hazardous waste materials and tube means underlying the floor. In one embodiment, a first and second module are provided. The invention further comprises a mechanical joining mechanism extending through the first module tube and the second module tube for securing the first module to the second module. The first and second modules are each formed as a single unitary hazardous waste material container storage building. A related method is also disclosed.

In another embodiment of the invention, each module includes a floor for supporting containers of hazardous waste, a plurality of sidewalls extending vertically from the floor and a roof disposed on top of the sidewalls. At least one securing means is attached to the roof and extending generally vertically upwardly therefrom. The invention further comprises a mechanical fastener connecting the first module securing means and the second module securing means. The first and second modules are formed as a single unitary hazardous waste material container storage building. A related method is also disclosed.

In another aspect of the invention, a hazardous waste material container storage building is disclosed comprising a floor for supporting containers of hazardous waste material, a plurality of sidewalls extending generally vertically from the floor and a roof disposed on top of the sidewalls. The containers are generally cylindrical having a diameter equal to about twenty inches to twenty-three and one-half inches and a height of about two to four feet. The floor is sectioned into generally square grids having sides of about twenty-four inches. In this way, the floor is proportioned to accommodate a plurality of containers without significant amounts of unused storage space.

It is an object of the invention to provide a modular building system to store containers of hazardous waste.

It is a further object of the invention to provide means for joining a plurality of modules to form a single unitary hazardous waste material storage container building.

It is a further object of the invention to provide a fast and efficient method of adding more modules to already existing hazardous waste material container storage buildings.

It is a further object of the invention to provide a hazardous waste material container storage building which uses minimum space to store a maximum number of barrels of hazardous waste.

It is a further object of the invention to provide a grid system which permits an unlimited number of configurations to efficiently and safely store barrels of hazardous waste.

It is a further object to provide an efficient securement of two or more modules to form a single, unitary hazardous waste material container storage building.

These and other objects of the invention will be fully understood from the following description of the invention with reference to the drawings appended to this application.

DESCRIPTION OF THE PREFERRED EMBODIMENTS

Figure 1:
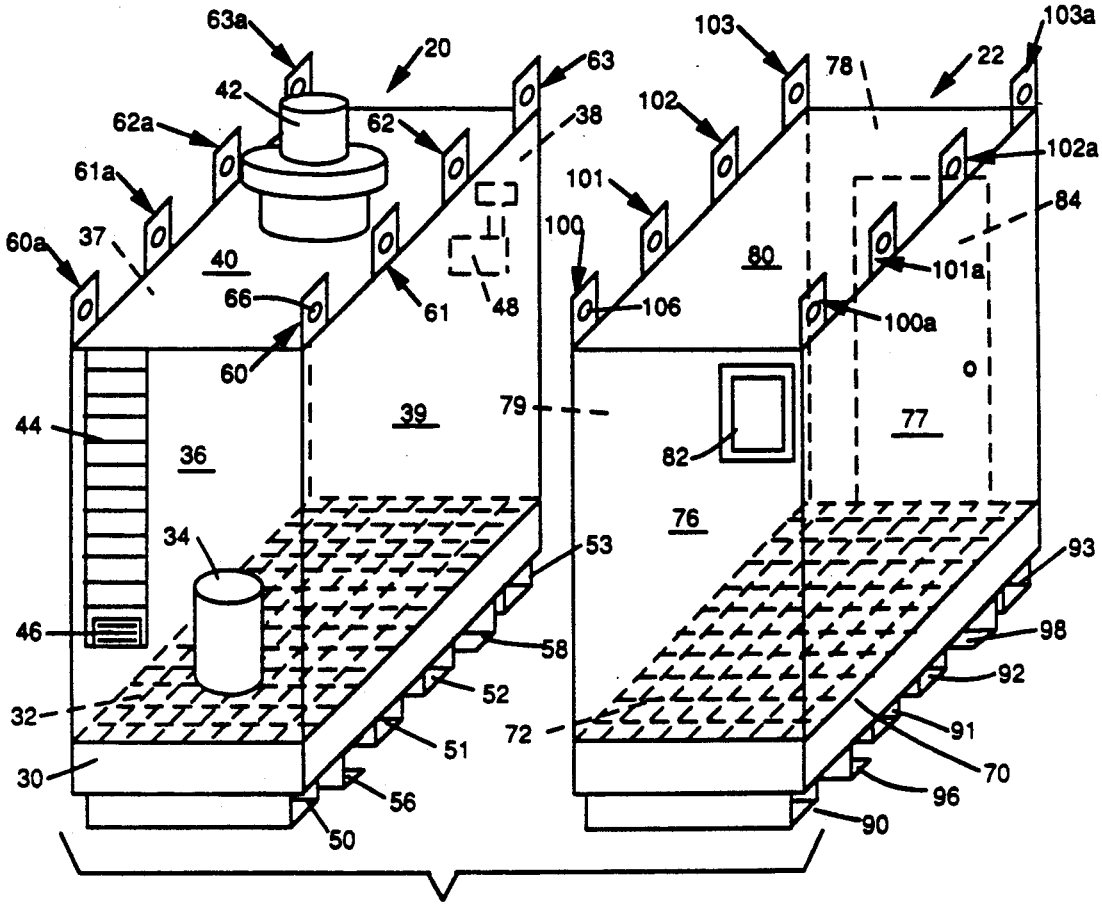
FIG. 1 is a perspective view of two spaced modules which together form a hazardous waste material container storage building.

Referring to FIG. 1 in greater detail, a first module 20 and a second module 22 which together form a single, unitary hazardous waste material container storage building are shown. Module 20 has a containment sump 30 which underlies an open grate flooring 32 made of steel or fiberglass. Flooring 32 supports a container 34 of hazardous waste material. Container 34 is typically in the form of a steel cylindrical barrel having a diameter of about twenty inches to twenty-three and one-half inches and a height of about two to four feet. Container 34 typically holds fifty-five gallons of hazardous waste material. Hazardous waste material can include solid and liquid hazardous waste.

The purpose of the containment sump 30 is to collect hazardous waste leakage that escapes from the container 34 and passes through the flooring 32. Containment sump 30 is self-contained in module 20 and is totally sealed from the ground upon which the module rests. The containment sump 30 also provides a visual indication of the leakage from the container 34.

Module 20 is further comprised of lateral walls 36, 37 and 38 extending generally vertically upwardly from flooring 32. One side of the module 20 has an open end 39. Disposed on top of the lateral walls 36, 37 and 38 is a roof 40. The walls 36, 37 and 38 and roof 40 can be ten gauge non-combustible steel construction. The building can be easily converted to a two-hour fire rated building by the addition of a layer of one and one-half inch insulation fiberglass batt sandwiched by two layers of one and one-half inch gypsum. The floor space in module 20 is approximately 408 square feet (34 feet length by 12 feet in width) and the module 20 has an approximate height of six feet. As will be explained further hereinafter with respect to FIG. 13, the module 20 is designed on a twenty-four inch by twenty-four inch square grid system which will accommodate containers of hazardous waste, such as container 34.

First module 20 also may include a ventilator fan 42 mounted on the roof 40. The ventilator fan 42 can be mounted on the lateral walls 36–38 if desired. A ladder 44 is optionally provided on lateral wall 36 to provide access to the roof 40 of module 20. Disposed near the bottom of ladder 44 is a dampered vent 46 which allows escape of gaseous fumes from the inside of the building. Module 20 is also provided with a dry chemical fire suppression system 48.

Disposed beneath the containment sump 30 are four elongated tube means 50, 51, 52 and 53. The tube means 50, 51, 52 and 53 are hollow and in spaced parallel relationship to each other. The tube means 50–53 have a square configuration with dimensions of approximately four inches by four inches, the walls of the tubes 50–53 being about one-quarter of an inch thick. The containment sump 30, lateral walls 36, 37 and 38 and roof 40 are supported on and by the tubes 50, 51, 52 and 53. Also provided beneath the containment sump 30 are elongated supports 56 and 58 which are shown having a generally "C" shape. These supports 56 and 58 provide additional containment sump 30 support for the module 20 while also permitting visual access to the underside of the building.

Mounted to the roof 40 are securing means 60, 61, 62 and 63 and securing means 60*a*, 61*a*, 62*a* and 63*a*. Each securing means 60–63 and 60*a*–63*a* has a respective aperture, such as aperture 66 in securing means 60. All of the securing means are similarly designed and securing means 60 will be described in detail hereinafter with respect to FIG. 2. The securing means not only serve to join the modules to form a single, unitary hazardous waste material container storage building, but also serve as lifting lugs for moving and lifting module 20.

Module 22 is similar to module 20 and includes a containment sump 70 which underlies an open grate flooring 72. Flooring 72 is adapted to support hazardous waste material containers. As with containment sump 30, sump 70 collects hazardous waste leakage that escapes from containers of hazardous waste through flooring 72. Module 22 is further comprised of lateral walls 76, 77 and 78. One side 79 of module 22 is open. Disposed on top of lateral walls 76, 77 and 78 and secured thereon is a roof 80. The lateral walls 76, 77 and 78 and roof 80 are of the same construction and size as lateral walls 36, 37, 38 and roof 40, respectively. A vent 82 is provided in lateral wall 76 and a door 84 is provided in lateral wall 78. When modules 20 and 22 are joined together as will be explained hereinafter, a single unitary hazardous waste material container storage building is formed.

Disposed beneath containment sump 70 are four elongated tube means 90, 91, 92 and 93. The tube means 90, 91, 92 and 93 are similar to tube means 50–53 and are in spaced parallel relationship to each other. The tube means 90–93 are hollow having a square configuration with dimensions of approximately four inches by four inches, the walls of the tubes 90–93 being about one-quarter of an inch thick. The containment sump 70, lateral walls 76, 77 and 78 and roof 80 are supported on and by the tube means 90, 91, 92 and 93. Also provided beneath the containment sump 70 are supports 96 and 98 which are shown having a generally "C" shape. These supports 96 and 98 provide additional containment sump support for the module 22 while also permitting visual access to the underside of the building.

Mounted to the roof 80 are securing means 100, 101, 102 and 103 and 100*a*, 101*a*, 102*a* and 103*a*. Each securing means 100–103 and 100*a*–103*a* has a respective aperture, such as aperture 106 in securing means 100. These securing means will also be discussed in detail hereinafter with respect to FIG. 2. The securing means not only serve to join the modules as one building, but also serve as lifting lugs for moving and lifting module 22.

Figure 2:
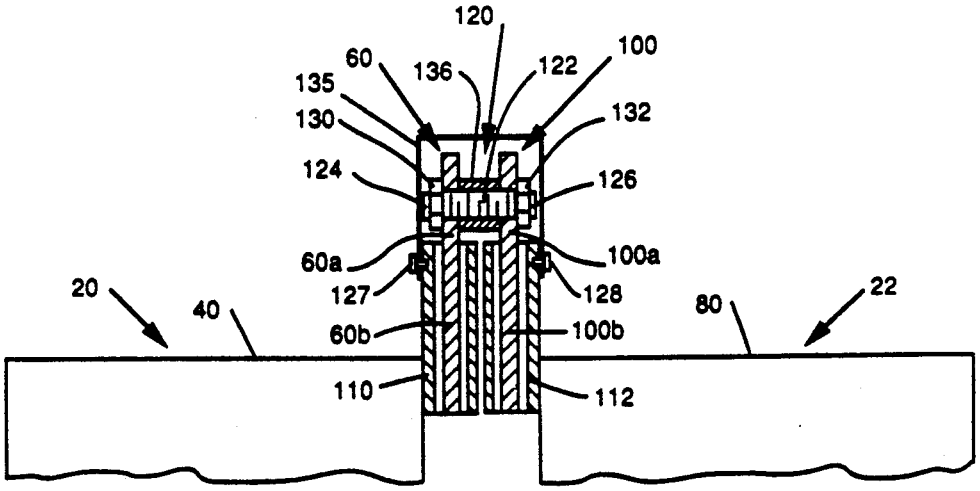
FIG. 2 is a partial side cross-sectional view of the modules joined together at the roof by the roof mechanical fastening means.

Referring now to FIG. 2, when it is desired to join module 20 to module 22, the modules 20 and 22 are moved so that the securing means 60, 61, 62 and 63 and securing means 100, 101, 102 and 103 have their respective apertures, such as 66 and 106, axially aligned. As can be seen in FIG. 2, securing means 60 is mounted in an elongated roof support tube 110 that forms part of the roof 40. A portion 60*a* of the securing means 60 extends above roof support tube 110 and a portion 60*b* is attached to the roof support tube 110 such as by welding. Securing means 100 is mounted in an elongated roof support tube 112 that is mounted to roof 80. A portion 100*a* of the securing means 100 extends above roof support tube 112 and a portion 100*b* is attached to the roof support tube 110 as by welding.

Once the securing means are axially aligned, a mechanical fastening means 120 is used to connect the securing means 60 and 100 and then join the two modules 20 and 22 to form a single unitary hazardous waste material container storage building. The mechanical fastening means 120 includes a bolt 122 having a first threaded end portion 124 extending axially outwardly of portion 60*a* of securing means 60 and a second threaded end portion 126 extending axially outwardly of portion 100*a* of securing means 100. A first nut 130 is threaded onto the first threaded end portion 124 and is tightened down to be in intimate surface-to-surface securing contact with portion 60*a*. A second nut 132 is then threaded onto the second threaded end portion 126 and is tightened down to be in intimate surface-to-surface securing contact with portion 100*a*. It will be appreciated that a bolt having a threaded end and a fixed bolt head can also be used.

A cap 135 is provided to cover the securing means 60 and 100 and the fastening means 120. The cap 135 is preferably elongated and covers all securing means 60–63 and 100–103. The cap 135 is fastened to tubes 110 and 112 by fasteners, such as bolts 127 and 128 respectively. An annular hollow spacer 136 is provided around the fastening means 120. This spacer 136 not only covers the fastening means 120 but also facilitates in aligning and positioning the modules 20 and 22.

It will be appreciated that a plurality of modules can be joined together as contemplated by the invention. A third module (not shown) could be attached to module 22 by utilizing securing means 100*a*–103*a* and four respective securing means on the third module.

Figure 3:
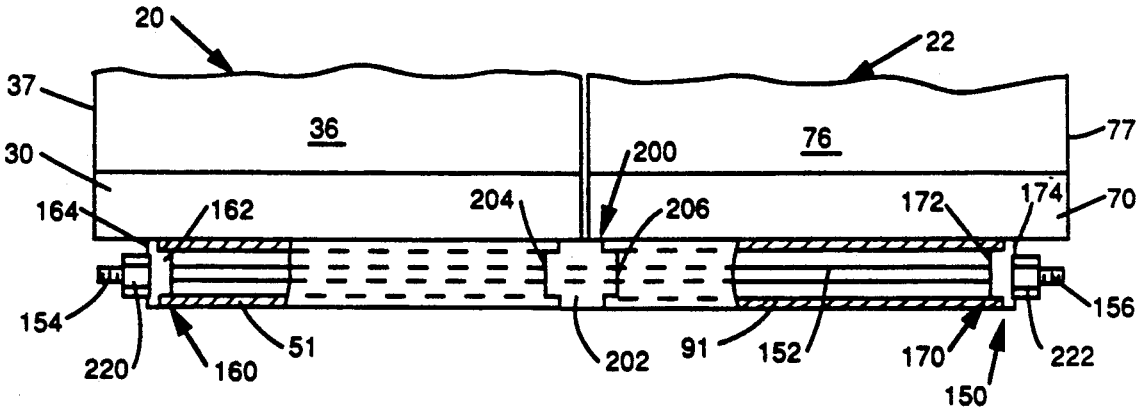
FIG. 3 is a partial detailed side elevational view, partially in section, of the modules joined together by the tube joining means.
Figure 4:
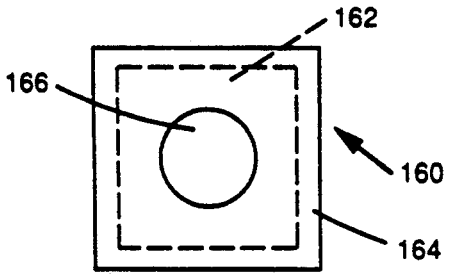
FIG. 4 is an elevational view of the end plate of the tube joining means.

Another method of joining modules 20 and 22 is shown in FIG. 3. In this embodiment, elongated parallel tube means 50–53 are axially aligned with tube means 90–93. An elongated mechanical joining means 150 is shown which includes an elongated rod 152 having a first threaded end portion 154 and a second threaded end portion 156. The first threaded end portion 154 extends axially outwardly of the tube means 51 and the second threaded end portion 156 extends axially outwardly of the tube means 91, but both threaded end portions 154 and 156 are recessed from the edge of lateral walls 37 and 77 respectively as is shown in FIG. 3. A first end plate 160 is provided on threaded end portion 154. The first end plate 160 has a base section 162 and an enlarged section 164. Base section 162 is dimensioned so as to fit inside tube 51, whereas enlarged section 164 is dimensioned so as to contact the outside edges of tube 51 as is shown in FIG. 3. Referring to FIG. 4, end plate 160 has an aperture 166. The elongated rod 152 passes through aperture 166.

A second end plate 170 is also provided on threaded end portion 156. The second end plate 170 has a base section 172 and an enlarged section 174. Base section 172 is dimensioned so as to fit inside tube 91 whereas enlarged section 174 is dimensioned so as to contact the outside edges of tube 91 as is shown in FIG. 3. Second end plate 170 has a similar aperture (not shown) as does first end plate 160, through which rod 152 passes.

Figure 5:
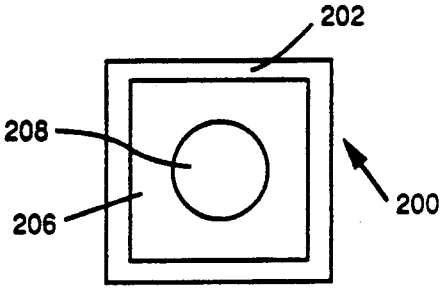
FIG. 5 is an elevational view of the divider plate of the tube joining means.

A divider plate 200 is disposed between tubes 51 and 91. The divider plate 200 helps to resist shifting of the building. The divider plate has an enlarged central section 202, a first end section 204 and a second end section 206. Enlarged central section 202 is dimensioned so as to contact the outside edges of both tubes 51 and 91 whereas sections 204 and 206 are dimensioned so as to fit inside tube 51 and tube 91 respectively. Referring to FIG. 5, the divider plate has an aperture 208 through which passes rod 152.

In the method of joining modules 20 and 22, divider plate 200 is positioned in the tubes 51 and 91 and rod 152 is passed through aperture 208 so that first threaded end portion 154 extends axially outwardly of tube 51 and second threaded end portion 156 extends axially outwardly of tube 91. It will be appreciated that divider plate 200 can also be first placed into either tube 51 or 91 and when module 20 or 22 is moved towards the other module, the free end of the divider plate 200 containing the protruding section can engage the inside of the tube means of the other module. Once the rod 152 is passed through the divider plate 200, the first end plate 160 and second end plate 170 are positioned as shown in FIG. 3. After this a first nut 220 is threaded onto first threaded end portion 154 and tightened down into intimate surface-to-surface contact with end plate 160. Finally, a second nut 222 is threaded onto second threaded end portion 156 and tightened down into intimate surface-to-surface contact with end plate 170. This will act to draw the modules 20 and 22 together to form a single, unitary hazardous waste material container storage building.

The tubes 50–53 and 90–93 provide an aesthetically pleasing appearance to the outside of the building. Tubes 50, 53, and 90, 93 located on the outside edges at the modules 20 and 22 prevent visual access to the underside of the building, thus making for a more streamlined appearance. If desired, the outside tubes 50, 53 and 90, 93 can be broken into sections so that one module has a discontinuous tube. This will facilitate access to the middle of a rod placed in the tube, but of course will affect the aesthetic appearance of the building.

The tubes also provide protection to the underside of the containment sumps 30 and 70 and generally provide structural support to the modules 20 and 22. The tube/-rod connection not only holds the modules 20 and 22 together, but also is used by the installers to pull the modules together once the lifting crane has the modules 20 and 22 within inches of each other. In addition, the tubes facilitate the feeding of rod 152 under the building during installation. Finally, the tubes protect the rod 152 from attack by corrosive ambient elements underneath the building and essentially act to "seal" the rod 152 from the elements.

It will be appreciated that the securing means of FIG. 2 can be used together with the joining means shown in FIGS. 3–5.

Figure 6:
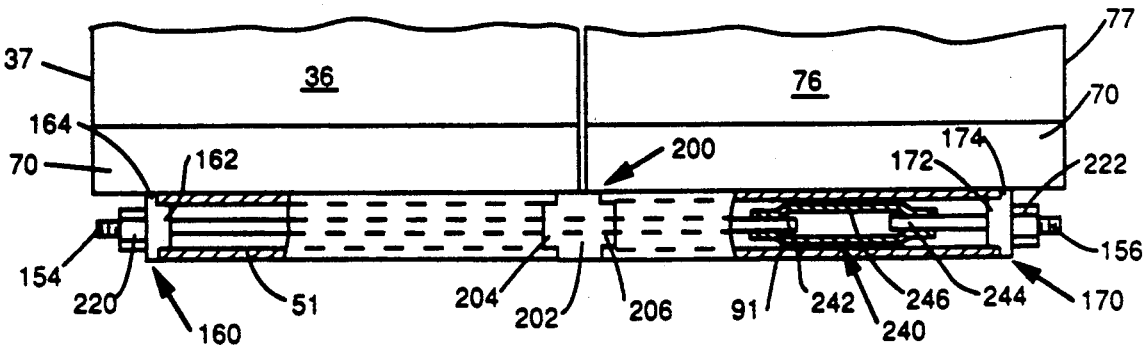
FIG. 6 is a view similar to FIG. 3 only showing another embodiment of the tube joining means.

Referring to FIG. 6, where like parts to those of FIG. 4 are identified by like reference numbers, an alternate embodiment of the rod means is shown. The rod means 240 in this embodiment consists of two separate rods 242 and 244 which are joined by a turnbuckle means 246. The rods used are typically in twenty foot sections, so when it is desired to lengthen the rod, two or more rods can be joined together using the turnbuckle 246.

Figure 7:
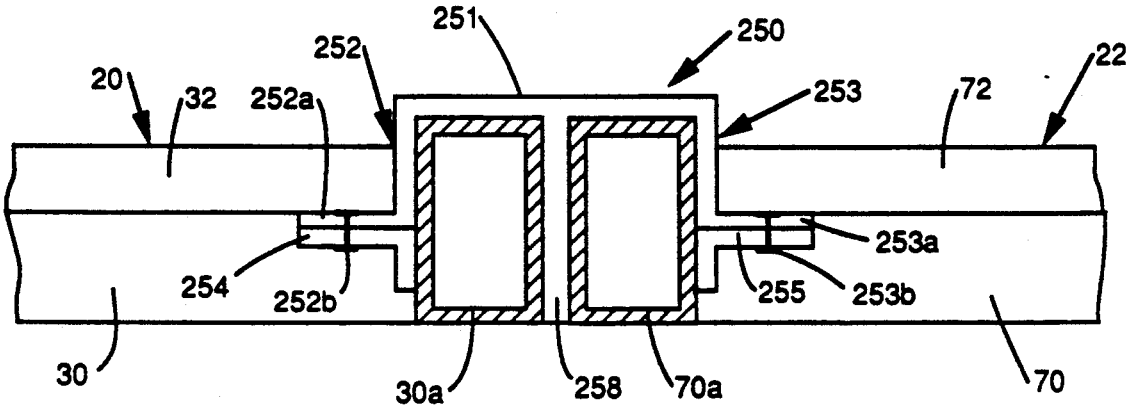
FIG. 7 is a partial side cross-sectional view of the modules joined together showing the containment sump cap.
Figure 7A:
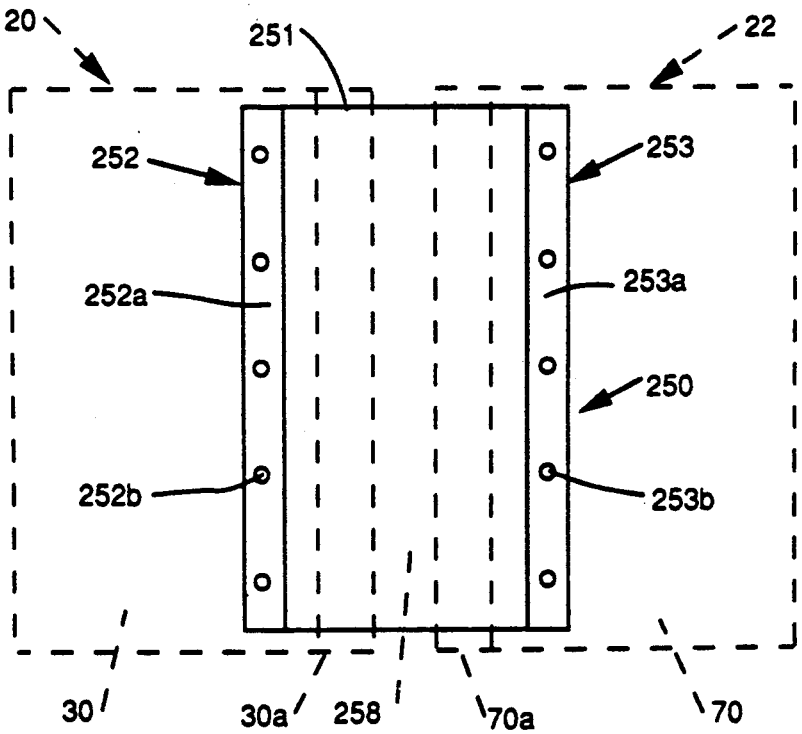
FIG. 7*a* is a top plan view of the modules joined together showing the containment sump cap.

Referring now to FIGS. 7 and 7*a*, the containment sump cap 250 of the invention will be explained. Once the modules 20 and 22 are joined together, it is desired to provide containment sump integrity. As was explained hereinbefore and was shown in FIG. 1, each module 20 and 22 has its own self-contained containment sump 30 and 70. This will promote containment sump integrity by providing a single containment sump for each module 20 and 22. Each containment sump 30 and 70 has an outer longitudinal hollow containment sump member 30*a* and 70*a*.

In order to further enhance containment sump integrity, a containment sump cap 250 is provided. The containment sump cap 250 has a top horizontal portion 251, a first side L-shaped flange 252 attached to the top portion 251 and a second side L-shaped flange 253 attached to the top portion 251. Portions 251, 252 and 253 can be integrally formed if desired. The horizontal sections 252*a* and 253*a* of the side flanges 252 and 253 are fastened by fasteners 252*b* and 253*b* to an elongated upside-down L-shaped members 254 and 255 connected to members 30*a* and 70*a*. Flooring 32 and 72 will rest on the horizontal sections 252*a* and 253*a* of flanges 252 and 253. The containment sump cap 250 will direct hazardous waste leakage into the containment sumps 30 and 70 and away from small opening 258 between modules 20 and 22, so as to resist hazardous waste leakage from reaching the ground upon which the modules rest.

Figure 8:
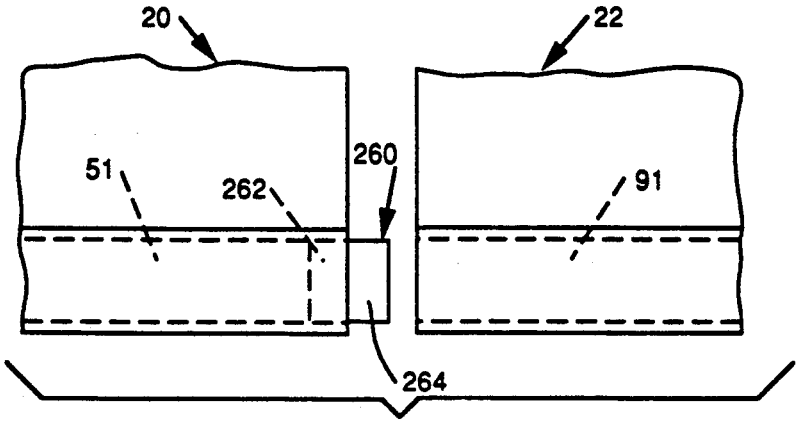
FIG. 8 is a detailed side elevational view showing the stabilizer plate as mounted in one tube and ready to be inserted into another tube.
Figure 9:
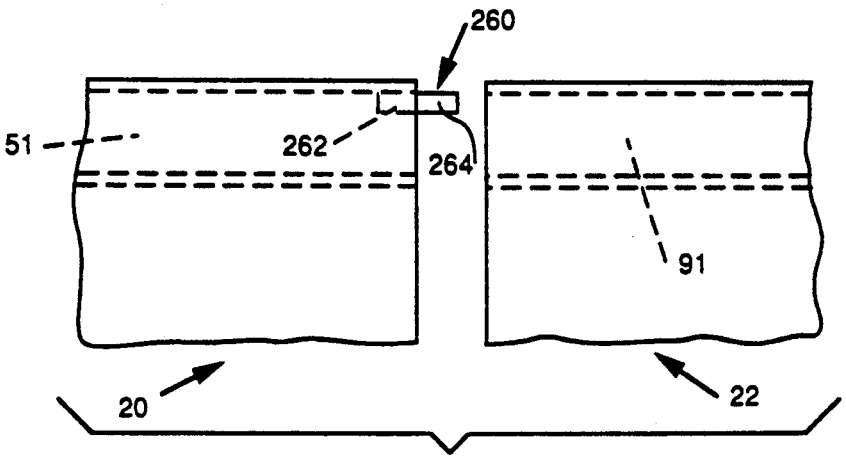
FIG. 9 is a top plan view of the stabilizer plate as mounted in one tube and ready to be inserted into another tube.

Referring now to FIGS. 8 and 9, a stabilizer plate 260 is shown which is mounted inside tube 51 and which is designed to fit into tube 91. The stabilizer plate 260 is used instead of the divider plate 200 shown in FIG. 3. The stabilizer plate 260 helps to align the tubes and properly join the two modules 20 and 22. Stabilizer plate 260 has a portion 262 secured to tube 51 as by welding and another free portion 264 which is designed to be disposed into tube 91 when the two modules 20 and 22 are joined to each other.

Figure 10:
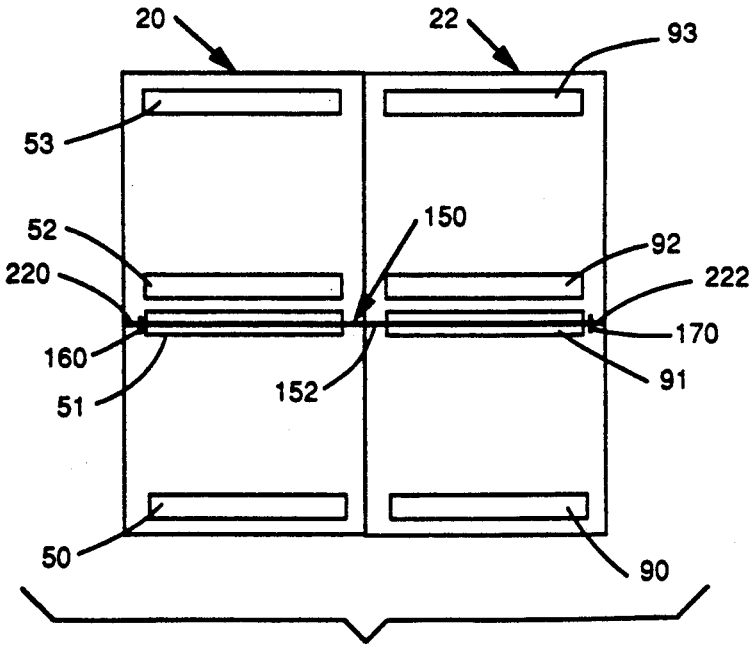
FIG. 10 is a schematic top plan view showing two modules joined together to form a unitary building.

Referring now to FIG. 10, a top plan schematic view of the two modules 20 and 22 as joined by the joining means 150 are shown. As described in connection with FIG. 1, module 20 has tubes 50, 51, 52 and 53 and module 22 has tubes 90, 91, 92 and 93. In order to join modules 20 and 22 to form a single unitary hazardous waste container storage building, module 20 is placed approximately in its final position and the joining means 150 is placed through tube 51 so that about half of the rod 152 protrudes from the right side of tube 51. The end plate 160 is placed on the rod 152 and into position in the tube 51 as shown on FIG. 3. Nut 220 is then tightened down and welded into intimate surface-to-surface contact with end plate 160 so that end plate 160 is in securing contact with the left side of tube 51. Next, module 22, having tube 91, is moved into position so that the protruding portion of the rod 152 is inserted into tube 91. The tubes 90–93 are axially aligned with tubes 50–53. The end plate 170 is placed onto the rod 152 and nut 222 is tightened down and welded into intimate surface-to-surface contact with end plate 170 so that end plate 170 is in securing contact with the right side of tube 91. In this way, modules 20 and 22 will be joined as a single, unitary hazardous waste material storage containment building.

It will be appreciated that either the divider plate 200 or the stabilizer means 260 can be used to align and stabilize the buildings. For simplicity and clarity of illustration, neither of those mechanisms are shown on FIGS. 10–12.

Figure 11:
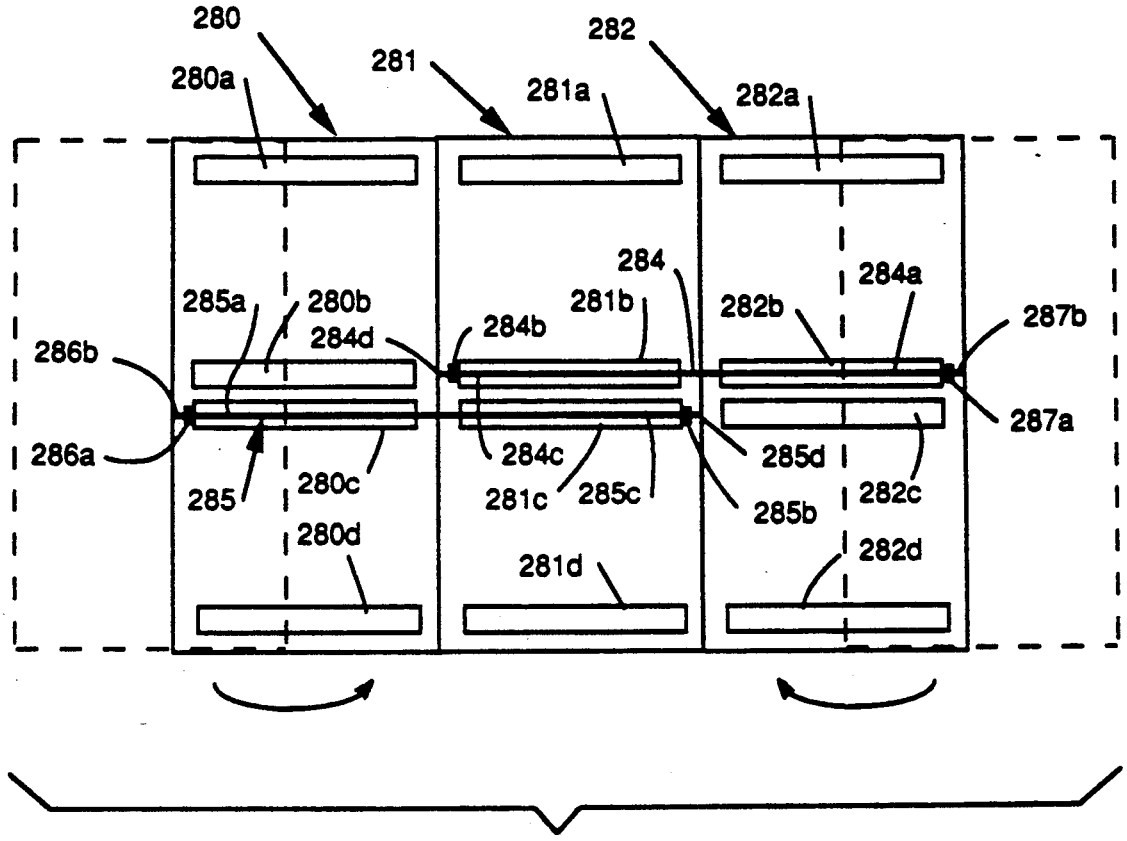
FIG. 11 is a schematic top plan view showing three modules joined together to form a unitary building.

FIG. 11 shows a top plan schematic view of joining three modules 280, 281 and 282 to form a single unitary building. Module 280 includes tubes 280*a*, 280*b*, 280*c* and 280*d* and similarly, module 281 has tubes 281*a*, 281*b*, 281*c* and 281*d* and module 282 has tubes 282*a*, 282*b*, 282*c* and 282*d*. Module 280 and 282 are "end modules" having one closed lateral wall and one open lateral wall, whereas module 281 is a "middle module" which has two open lateral walls. It will be appreciated that when modules 280, 281 and 282 are joined together, the building has no interior partitions.

The method of joining modules 280, 281 and 282 is as follows: The middle module 281 is placed into its position first and a first rod means 284 is placed through tube 281*b* so that the right portion 284*a* of rod 284 protrudes from the right side of tube 281*b*. An end plate 284*b* is placed on the left portion 284*c* of the rod 284 and a nut 284*d* is tightened down and welded into intimate surface-to-surface contact with end plate 284*b* so that end plate 284*b* is in securing contact with tube 281*b* similar to end plate 160 on tube 51 as shown in FIG. 3. Next, a second rod means 285 is placed through tube 281*c* so that the left portion 285*a* of the rod 285 protrudes from the left side of tube 281*c*. An end plate 285*b* is placed on the right portion 285*c* of the rod 285 and a nut 285*d* is tightened down and welded into intimate surface-to-surface contact with end plate 285*b* so that end plate 285*b* is in securing contact with the right edge of tube 281*c*.

The next step is that either module 280 or 282 is moved into place. For example, module 280 is moved from the phantom position shown in FIG. 11 to its final position so that left portion 285*a* of rod 285 is inserted into tube 280*c*. An end plate 286*a* is placed on the left portion 285*a* of rod 285 and a nut 286*b* is tightened down and welded into intimate surface-to-surface contact with end plate 286*a* so that end plate 286*a* is in securing contact with the left edge of tube 280*c*. Finally, module 282 is moved from the phantom position shown in FIG. 11 to its final position so that right portion 284*a* of rod 284 is inserted into tube 282*b*. An end plate 287*a* is placed on the right portion 284*a* of rod 284 and a nut 287*b* is tightened down and welded into intimate surface-to-surface contact with end plate 287*a* so that end plate 287*a* is in securing contact with the right edge of tube 282*b*. In this way modules 280, 281 and 282 are joined to form a single unitary hazardous waste material container storage building.

Figure 12:
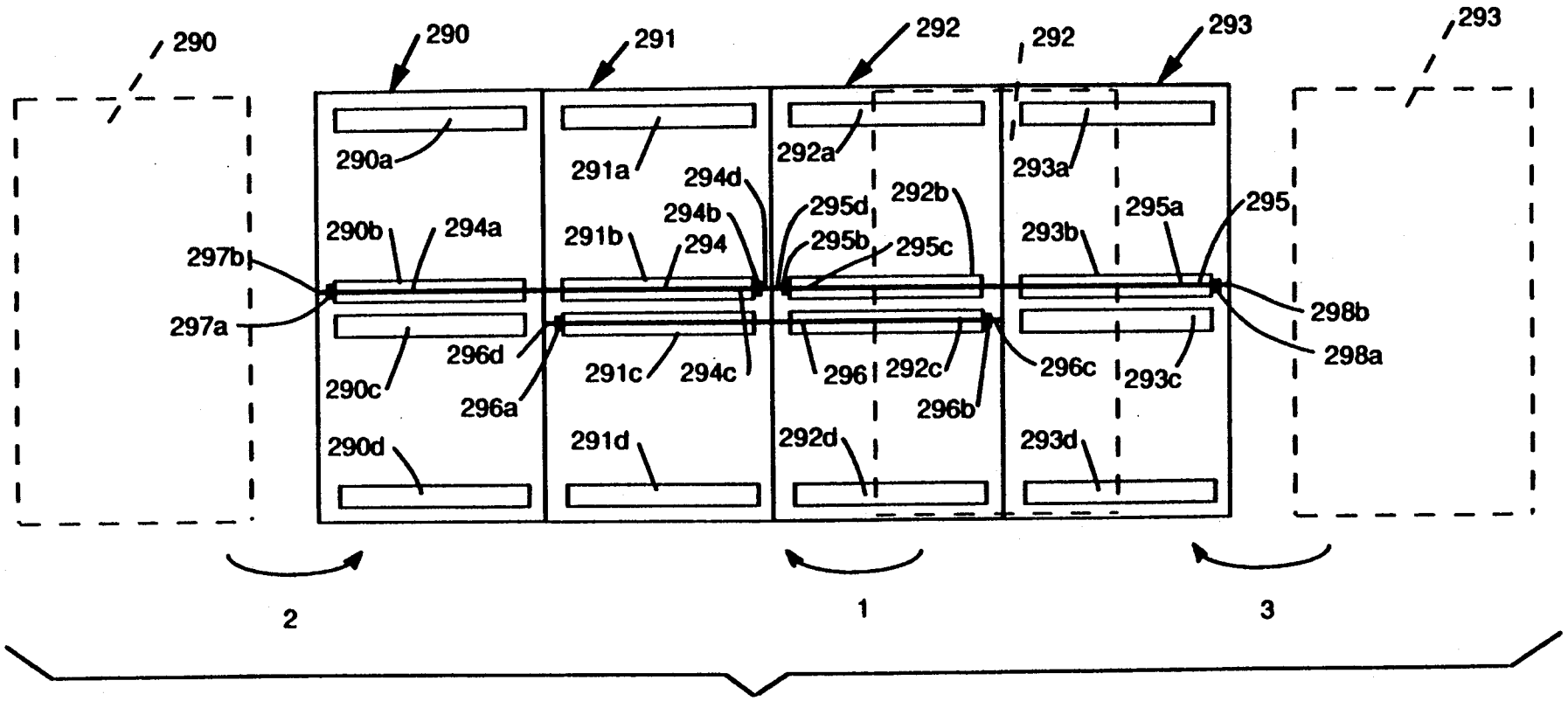
FIG. 12 is a schematic top plan view showing four modules joined together to form a unitary building.

FIG. 12 shows a top plan schematic view of four modules 290, 291, 292 and 293 that are joined together. These modules are joined to form a unitary building. Module 290 and 293 are "end modules" and modules 291 and 292 are "middle modules". Module 290 has tubes 290*a*, 290*b*, 290*c* and 290*d*. Module 291 has tubes 291*a*, 291*b*, 291*c* and 291*d*. Module 292 has tubes 292*a*, 292*b*, 292*c*, and 292*d* and module 293 has tubes 293*a*, 293*b*, 293*c* and 293*d*.

The method of joining modules 290, 291, 292 and 293 is as follows. One of the middle modules 291 or 292, for example 291 is placed into position and a first rod means 294 is placed through tube 291*b* so that left portion 294*a* of rod 294 protrudes from the left side of tube 291*b*. An end plate 294*b* is placed on the right portion 294*c* of the rod 294 and a nut 294*d* is tightened down and welded into intimate surface-to-surface contact with end plate 294*b* so that end plate 294*b* is in securing contact with the right edge of tube 291*b*. Next, module 292 is placed near to module 291 but not in its final position and a second rod means 295 is placed through tube 292*b* so that right portion 295*a* of rod 295 protrudes from the right side tube 292*b*. An end plate 295*b* is placed on the left portion 295*c* of the rod 294 and a nut 295*d* is tightened down and welded into intimate surface-to-surface contact with end plate 295*b* so that end plate 295*b* is in securing contact with left edge of tube 292*b*. After this step, a third rod means 296 is inserted through tube 291*c* and tube 292*c* to join modules 291 and 292. Module 292 is moved towards module 291 and are brought together to form a single sub-unit by using an end plate 296*a* on the left side of tube 291*c* and an end plate 296*b* of the right side of tube 292*c*. A nut 296*c* is tightened down and welded into intimate surface-to-surface contact with end plate 296*a* so that end plate 296*a* is in securing contact with left edge of tube 291*c*. A nut 296*d* is tightened down and welded into intimate surface-to-surface contact with end plate 296*b* so that end plate 296*b* is in securing contact with right edge of tube 292*c*. At this point modules 291 and 292 form a single sub-unit.

Module 290 or module 293 can then be joined to the module 291 module 292 sub-unit. Module 290, for example, is moved from the phantom position shown in FIG. 11 to its final position so that left portion 294*a* of rod 294 is inserted into tube 290*b*. An end plate 297*a* is placed on the left portion 294*a* of rod 294 and a nut 297*b* is tightened down and welded into intimate surface-to-surface contact with end plate 297*a* so that end plate 297*a* is in securing contact with the left edge of tube 290*b*. This will form a sub-unit of module 290/module 291/module 292. Module 293 is then moved from the phantom position shown in FIG. 11 to its final position so that right portion 295*a* of rod 295 is inserted into tube 293*b*. An end plate 298*a* is placed on the right portion 295*a* of rod 295 and a nut 298*b* is tightened down and welded into intimate surface-to-surface contact with end plate 298*a* so that end plate 298*a* is in securing contact with the right edge of tube 293*b*. In this way, modules 290, 291, 292 and 293 are joined to form a single unitary hazardous waste material container storage building.

It will be appreciated that five or more modules can be joined together by utilizing a similar procedure as was described above. For joining a fifth module to the four modules shown in FIG. 12, before the last step of joining module 293 to the module 290/module 291/module 292 sub-unit, another rod would be placed in tube 293*c* to extend into the tube of a fifth module. That new rod would be welded to the left side of tube 293*c* and then module 293 would be joined to form a four module unit. Finally, the fifth module would be joined to the four module sub-unit. It will be appreciated that any number of modules can be utilized with this system. The concept is to start at the middle and add on to the sub-units that are formed until the desired size building achieved. To add a new module to an existing building, a new middle module would be shipped to the customer, and the middle module placed in between an existing end module such as module 280 in FIG. 11 and an existing middle module such as 281 in FIG. 11. This would necessitate breaking the weld for the nuts that are threaded onto the rods.

Figure 13:
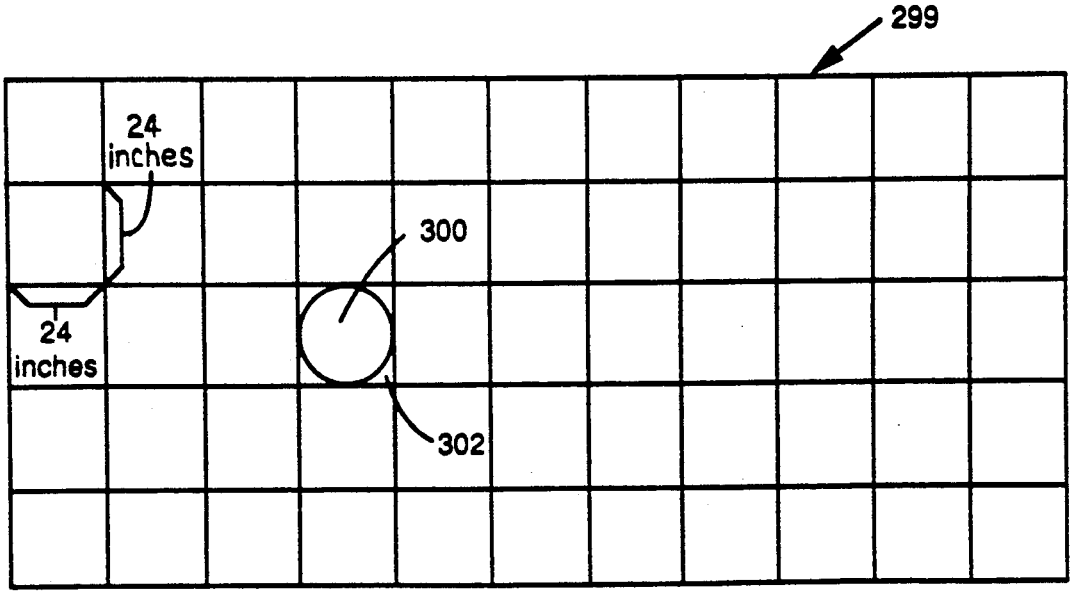
FIG. 13 is a schematic diagram of a floor used to support hazardous waste material containers which illustrates the grid design system of the invention.

Referring now to FIG. 13, the grid design system of the invention will be explained. Each module is designed to have an interior flooring grid system, with each grid being a square having sides of twenty-four inches. The grids can be marked on the floor if desired, but this is not necessary. As was explained hereinbefore, containers of hazardous waste are stored in cylindrical barrels having a diameter of about twenty to twenty-three and one-half inches and a height of about two to four feet. FIG. 12 shows the footprint of a barrel 300 in grid 302. The footprint is defined as the area of the floor underlying the barrel 300 when it rests on the floor. The barrel 300 is positioned in the grid so that there will be maneuvering room and spare space to allow a user's fingers to access the barrels. The grid design system keeps the building's total square footage to a minimum because the maximum amount of barrels is fit into the minimum amount of space. The grid design system also provides a method to allow aisles in the building by not placing barrels in certain grids. This allows "free and clear" access to the barrels in the building.

It will be appreciated that one method of the invention includes providing a first module having a floor for supporting containers of hazardous waste material and tube means underlying the floor and a second module having a floor for supporting containers of hazardous waste material and tube means underlying the floor. The method further comprises effecting relative closing displacement between the first and second modules and joining the first module to the second module by providing mechanical joining means extending at least partially through the first module tube means and the second module tube means.

An alternate method of the invention includes providing a first module having a floor for supporting containers of hazardous waste material, a plurality of sidewalls extending generally vertically from the floor, a roof disposed on the top of the sidewalls and securing means attached to the roof and extending generally vertically upwardly therefrom. The method further includes providing a second module having a floor for supporting containers of hazardous waste material, a plurality of sidewalls extending generally vertically from the floor, a roof disposed on top of the sidewalls and securing means attached to the roof and extending generally vertically upwardly therefrom. The method further includes effecting relative closing displacement between the first and second modules and joining the first module to the second module by providing fastening means passing through the first module securing means aperture and the second module securing means aperture.

It will be appreciated that a hazardous waste material container storage building is provided comprising a plurality of modules which are joined together to form a single unitary hazardous waste material container storage building.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A method of joining a plurality of modules to form a single, unitary hazardous material container storage building comprising:

providing a first module having (i) a floor for supporting containers of hazardous material; (ii) a containment sump disposed underneath said floor for collecting leakage from said containers; and (iii) tube means underlying said containment sump;

providing a second module having (i) a floor for supporting containers of hazardous material; (ii) a containment sump disposed underneath said floor for collecting leakage from said containers; and (iii) tube means underlying said containment sump;

effecting relative closing movement between said first and second modules; and joining said first module to said second module by passing first mechanical joining means extending at least partially through said first module tube means and said second module tube means and securing said joining means in position.

2. The method of claim 1, including providing a third module disposed generally adjacent to said first or second module, said third module having (i) a floor for supporting containers of hazardous material; (ii) a containment sump disposed underneath said floor for collecting leakage from said containers; and (iii) tube means underlying said containment sump;

effecting relative closing movement between said third module and said first or second module; and joining said first module or said second module to said third module by passing second mechanical joining means extending at least partially through said third module tube means and said first or second module tube means and securing said second mechanical joining means in position.

3. The method of claim 2, including;

employing said method to secure at least one additional module to said three modules.

4. The method of claim 2, including;

providing said first module with a first tube and a second tube, said first and second tubes being in a generally parallel relationship;

providing said second module with a first tube and a second tube, said first and second tubes being in a generally parallel relationship;

providing said third module with a first tube and a second tube, said first and second tubes being in a generally parallel relationship; and prior to effecting relative closing movement between said first and second modules securing said first mechanical joining means to one end of said first tube of said second module so that a portion of said first mechanical joining means extends from the opposite end of said first tube of said second module;

securing said second mechanical joining means to the end of said second tube of said second module opposite of the end where said first mechanical joining means is secured to said first tube of said second module so that a portion of said second mechanical joining means extends from the opposite end of said second tube of said second module;

effecting relative movement of said first module towards said second module so that said first mechanical joining means extending portion is inserted into said first tube of said first module;

joining said first module to said second module by securing said opposite end of said first mechanical joining means to said first tube of said first module;

effecting relative movement of said third module towards said second module so that said second mechanical joining means extending portion is inserted into said second tube of said second module; and joining said third module to said second module by securing said opposite end of said second mechanical joining means to said second tube of said third module.

5. The method of claim 4, including employing said method to secure at least one additional module to said three modules.

* * * * *